US007004506B2

(12) United States Patent
Downes et al.

(10) Patent No.: US 7,004,506 B2
(45) Date of Patent: Feb. 28, 2006

(54) LOTTERY TICKET PLAY ACTION GAME

(75) Inventors: Kevin Paul Downes, St. Clair (AU); Geneva McCaffrey, San Antonio, TX (US); Carla Schaefer, San Antonio, TX (US)

(73) Assignee: Oberthor Gaming Technologies, Inc., Montreal (CA)

( * ) Notice: Subject to any disclaimer, the term of this patent is extended or adjusted under 35 U.S.C. 154(b) by 0 days.

(21) Appl. No.: 09/896,174

(22) Filed: Jun. 29, 2001

(65) Prior Publication Data

US 2002/0093188 A1 Jul. 18, 2002

Related U.S. Application Data

(60) Provisional application No. 60/215,853, filed on Jul. 3, 2000, provisional application No. 60/235,444, filed on Sep. 26, 2000.

(51) Int. Cl.
*A63F 3/00* (2006.01)

(52) U.S. Cl. ..... 283/62; 283/903; 283/117; 283/49; 283/72; 273/138.1; 273/139; 273/269; 273/270

(58) Field of Classification Search ..... 283/903, 283/117, 49, 72, 62; 273/139, 138.1, 269, 273/270

See application file for complete search history.

(56) References Cited

U.S. PATENT DOCUMENTS

| | | | | |
|---|---|---|---|---|
| 5,451,052 | A * | 9/1995 | Behm et al. | 283/903 |
| 5,782,470 | A * | 7/1998 | Langan | 273/139 |
| 5,803,504 | A * | 9/1998 | Deshiens et al. | 293/903 |
| 5,944,354 | A * | 8/1999 | Feola | 283/903 |
| 6,044,135 | A * | 3/2000 | Katz | 283/903 |
| 6,241,246 | B1 * | 6/2001 | Guttin et al. | 283/903 |
| 6,250,685 | B1 * | 6/2001 | Walker et al. | 283/903 |
| 6,270,406 | B1 * | 8/2001 | Sultan | 283/903 |
| 6,296,250 | B1 * | 10/2001 | Langan | 273/139 |
| 6,491,297 | B1 * | 12/2002 | Cardoso | 273/138.1 |
| 6,811,484 | B1 * | 11/2004 | Katz et al. | 463/17 |
| 6,889,978 | B1 * | 5/2005 | Schaefer et al. | 273/139 |
| 2005/0140092 | A1 * | 6/2005 | Solano | 273/269 |

FOREIGN PATENT DOCUMENTS

GB 2163662 A * 3/1986

* cited by examiner

*Primary Examiner*—Boyer D. Ashley
*Assistant Examiner*—Mark Henderson
(74) *Attorney, Agent, or Firm*—Watov & Kipnes, P.C.

(57) ABSTRACT

A lottery ticket having a first game area having at least one row with each row containing a plurality of play indicia and a second game area adjacent each row of the first game area and containing a target indicia which if present may result in a prize being won.

7 Claims, 2 Drawing Sheets

LOTTERY TICKET PLAY ACTION GAME

This applcation claims the benefit of Provisional Application Nos. 60/215,853, filed Jul. 3, 2000 and 60/235,444, filed Sep. 26, 2000.

FIELD OF THE INVENTION

The present invention is directed to a lottery ticket based on chance which provides for the matching of one or a combination of play indicia such as playing card indicia from a first game area to a particular target indicia such as a target playing card indicia appearing in a second game area. If the target indicia is matched by the play indicia, the player may win a prize.

BACKGROUND OF THE INVENTION

Scratch-off lottery tickets are common in the lottery industry. Game data is covered by a scratch-off layer and when the scratch-off layer is removed, the game data is exposed. Once the scratch-off layer is removed, if the game symbols provide a certain pattern (e.g. three of the same symbol) the player may win a prize. Thus, the typical scratch-off lottery tickets require the player to remove the scratch-off layer and immediately determine what prize has been won.

It is desirable in the scratch-off lottery industry to provide lottery tickets which not only provide the opportunity to win a prize, but also provide the opportunity to play a game which adds to the value and enjoyment of the lottery ticket itself. It would therefore be a significant advance in the scratch-off industry to provide a lottery game which can provide the opportunity to play a game as well as win a prize.

SUMMARY OF THE INVENTION

The present invention is generally directed to a lottery ticket employing a game in which the player is provided with a first game area which contains play indicia which may be individually employed or combined. If the individual play indicia which can be in the form of a variety of symbols such as numbers, objects, playing card indicia (i.e. hearts, diamonds, spades and clubs) and the like or the combination of play indicia meets the requirements of a target indicia in a second game area, a prize may be won.

In a particular aspect of the present invention, there is provided a lottery ticket comprising a substrate having thereon:

a) a first game area comprising at least one row, each row containing a plurality of play indicia, said plurality of play indicia being covered by a scratch-off layer;

b) a second game area adjacent each row of the first game area, said second game area designating a target indicia which if present in the first game area results in a prize being won; and c) a prize area comprising prize designations for at least one of the rows of the first game area, wherein if a row of a first game area contains play indicia corresponding to the target indicia from the second game area, the player wins the prize designation set forth in the prize area of the row.

BRIEF DESCRIPTION OF THE DRAWINGS

The following drawings in which like reference characters indicate like parts are illustrative of embodiments of the invention and are not intended to limit the invention as disclosed in the application.

DETAILED DESCRIPTION OF THE INVENTION

Figure 1:
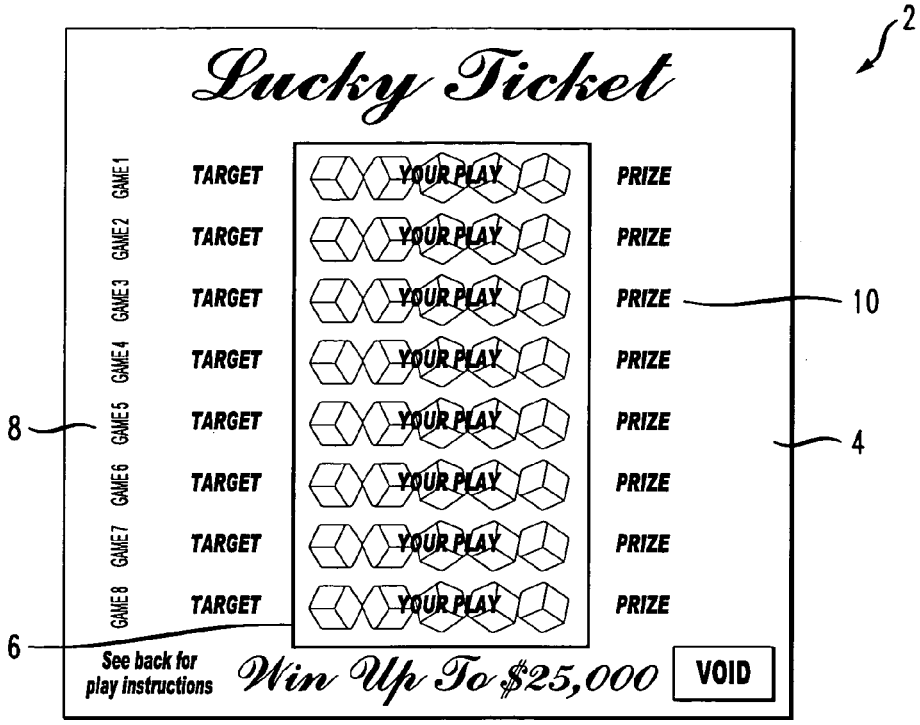
FIG. 1 is a top view of an embodiment of a lottery ticket of the present invention prior to playing.
Figure 2:
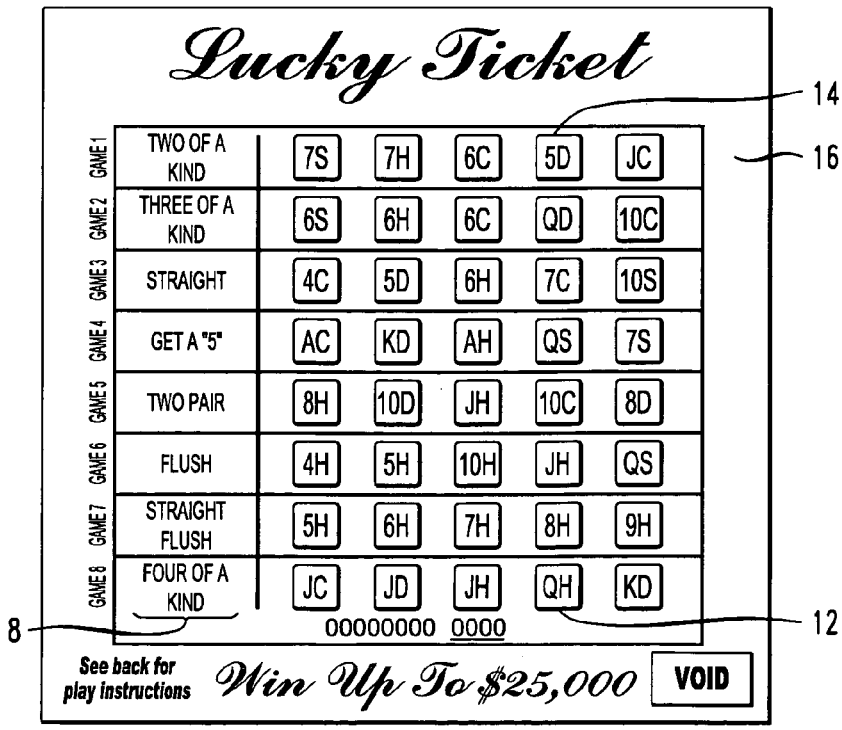
FIG. 2 is a top view of the lottery ticket shown in FIG. 1 after it has been played by removal of the scratch-off layer.

Referring to FIGS. 1 and 2, there is shown a lottery ticket as an embodiment of the present invention. The lottery ticket 2 has a top face 4 which includes a first game area 6, a second game area 8 and a prize designation area 10. The first game area 6 comprises a plurality of rows 12, preferably 3 to 10 rows (eight rows are shown) with each row containing a plurality of play indicia 14, preferably 3 to 6 play indicia (five play indicia are shown). As specifically shown in the embodiment of FIG. 2, the play indicia are playing card indicia, for example, which are associated with a standard deck of playing cards and may be selected from the 2 through the ace of hearts, diamonds, spades and clubs as represented in FIG. 2 by the letters H, D, S and C, respectively. Other play indicia can include, for example, number (e.g. numbers appearing on the face of dice, symbols, letters, icons, objects and the like.

The second game area 8 provides a particular target indicia which may be a single playing card indicia, multiple instances of a single playing card indicia or a scenario (e.g. a straight such as ten, jack, queen, king, ace) or a playing card indicia which may only be obtained by combining at least two multiple play indicia in the first game area. The second game area 8 provides a target indicia for each of the rows 12 corresponding to the first game area 6.

By way of example, the top row shown in FIG. 2 provides a target indicia which requires the player to reveal two of a kind to win a prize. A prize is won if after revealing the play indicia appearing in the first row 12 of the first game area 6, a pair is present. As shown by way of example in FIG. 2, the first game area meets the criteria of the target indicia by revealing a pair of "7's" (i.e. 7 of spades and 7 of hearts). The player is therefore entitled to a prize which may be observed in a prize area 16 which is adjacent each row 12 of the first game area 6.

In a second example, the second row in the second game area 8 requires three of a kind. A prize is won if, after revealing the play indicia appearing in the second row 12 of the first game area 6, three of a kind is present. As shown specifically in FIG. 2, the five play indicia in the second row of the first game area reveal three "6's" and therefore the player is entitled to a prize appearing in the corresponding row of the prize area 16.

In a further example, the fourth row in the second game area 8 requires a playing card with the number "5" of any suit. If a 5 of hearts, diamonds, spades or clubs were present, then the player would win a prize. Because a 5 is not present, no prize is won in this particular example.

The player removes the scratch-off layer from all of the rows from the first and second game areas, makes the appropriate computation to see if the respective target indicia are obtained by the play indicia in the first game area to see if a prize has been won.

Figure 3:
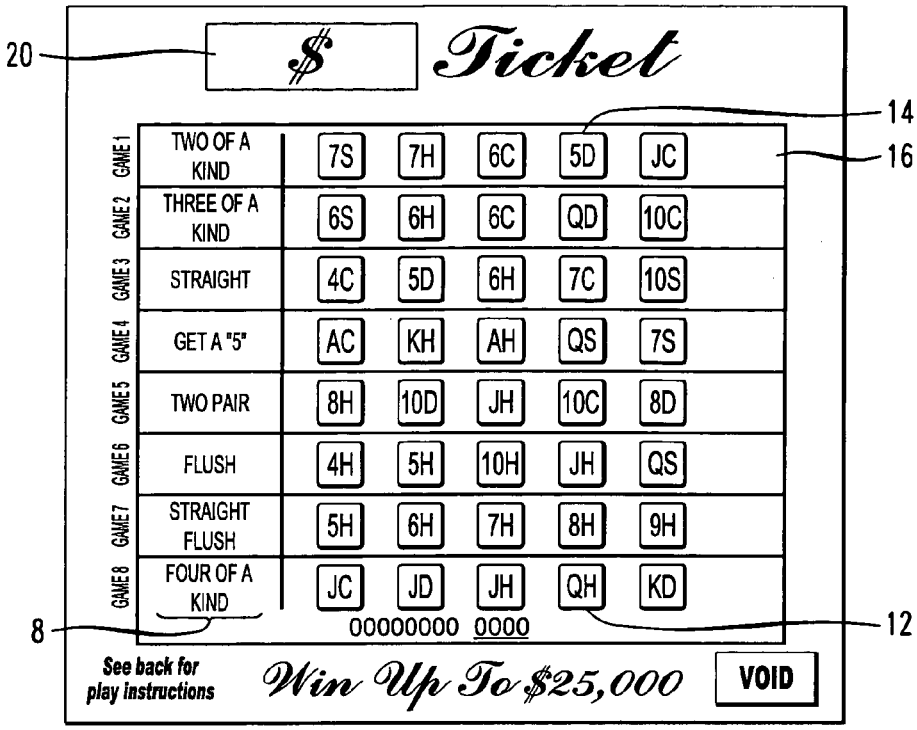
FIG. 3 is a top view of the lottery ticket shown in FIG. 2 including a bonus area.

In accordance with a preferred embodiment of the invention, there may be provided an additional bonus area as shown in FIG. 3 to provide a bonus prize or play action. By way of example, the word "Lucky" that appears on the front face of the lottery ticket is a third play area 20 which may be comprised of a scratch-off layer which when removed may expose an additional game (e.g. a bonus game), additional play indicia, additional target indicia or a multiplying feature such as doubling the prize or prizes won generally represented by the numeral 22. The third play area 20 may also designate a bonus (e.g. a dollar amount) prize separate from any prize that may be won playing the game.

Figure 4:
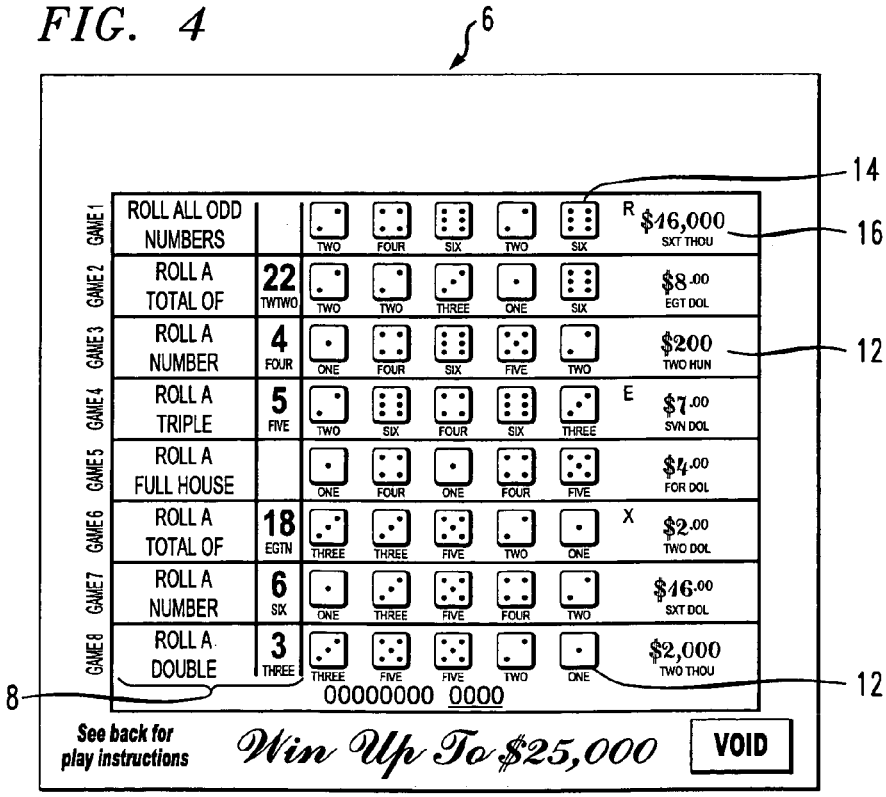
FIG. 4 is a top view of another embodiment of the lottery ticket of the present invention with the scratch-off layer removed.

In a further embodiment of the invention as shown in FIG. 4, the top row shown in FIG. 4 provides a target number in the second game area 8 which requires that all of the numbers in the corresponding row of the first game area 6 be odd numbers. A prize is won if all of the numbers appearing in the first row 12 of the first game area 6 are odd numbers. As shown by way of example in FIG. 4, the first game area fails to meet the criteria of the target number and therefore is not entitled to a prize which may be observed in a prize area 16 which is adjacent each row 12 of the first game area 6. As shown specifically in FIG. 4, the numbers in the first game area appear on the face of individual dice.

In a second example, the second row in the second game area 8 of FIG. 4 requires that the total of all of the play numbers in the first game area add up to 22. As shown specifically in FIG. 4, the five play numbers in the second row of the first game area do not add up to 22 and therefore the player is not entitled to the prize (i.e. $8) appearing in the corresponding row of the prize area 16.

What is claimed:

1. A lottery ticket comprising:

a) a first game area comprising a plurality of rows, each row having a first end and containing a plurality of play indicia wherein a single game is played with the first game area in conjunction with an adjacent row of a second game area such that the number of games in the first game area is equal to the number of rows;

b) a second game area comprising a plurality of rows and the same number of rows as the first game area, each one row of the second game area matched with an adjacent row in the first game area to form a single game row for playing a single game and being adjacent the first end of the adjacent row of the first game area, each row of the second game area designating a target indicia which if present in only the corresponding adjacent row of the first game area may result in a prize being won;

c) a prize area comprising prize designations for at least one of the rows of the first game area, wherein a player plays each of the rows and if a row of the first game area contains play indicia corresponding to the target indicia from the corresponding adjacent row of the second game area, a player may win a prize designation set forth in the prize area of the row; and d) and means for playing each of the single game rows of the first game area and second game area to see if a prize is won.

2. The lottery ticket of claim 1 wherein at least two indicia in the first game area are combined to obtain the target indicia in the second game area.

3. The lottery ticket of claim 1 comprising:

a first game area comprising a plurality of rows of play indicia with each play indicia appearing on a face of a playing card.

4. The lottery ticket of claim 1 comprising:

a first game area comprising a plurality of rows of play indicia with each play indicia appearing on a face of a dice.

5. The lottery ticket of claim 1 wherein at least some of the target indicia in the second game area are obtained by combining at least two play indicia from the first game area.

6. The lottery ticket of claim 1 wherein the first game area has from 3 to 10 rows with each row having from 3 to 6 play indicia present therein.

7. The lottery ticket of claim 1 comprising a third play area for designating a bonus prize, additional play numbers, additional target indicia or a multiplying feature.

* * * * *

UNITED STATES PATENT AND TRADEMARK OFFICE

CERTIFICATE OF CORRECTION

PATENT NO. : 7,004,506 B2 
DATED : February 28, 2006
INVENTOR(S) : Kevin Paul Downes et al.

It is certified that error appears in the above-identified patent and that said Letters Patent is hereby corrected as shown below:

Title page,
Item [73], Assignee, "Oberthor" should read -- Oberthur --.

Signed and Sealed this

Twenty-third Day of May, 2006

JON W. DUDAS
*Director of the United States Patent and Trademark Office*